US006680273B2

(12) United States Patent
Goosey et al.

(10) Patent No.: US 6,680,273 B2
(45) Date of Patent: Jan. 20, 2004

(54) PLATING CATALYSTS AND ELECTRONIC PACKAGING SUBSTRATES PLATED THEREWITH

(75) Inventors: Martin T. Goosey, Nuneaton (GB); Narinder Singh Bains, Wednesfield (GB)

(73) Assignee: Shipley Company, L.L.C., Marlborough, MA (US)

( * ) Notice: Subject to any disclaimer, the term of this patent is extended or adjusted under 35 U.S.C. 154(b) by 178 days.

(21) Appl. No.: 10/000,865

(22) Filed: Oct. 24, 2001

(65) Prior Publication Data

US 2002/0069788 A1 Jun. 13, 2002

(30) Foreign Application Priority Data

Oct. 24, 2000 (GB) ..... 0025990

(51) Int. Cl.[7] ..... B01J 31/00
(52) U.S. Cl. ..... 502/150; 438/678
(58) Field of Search ..... 502/150; 438/678

(56) References Cited

U.S. PATENT DOCUMENTS

| | | | | | |
|---|---|---|---|---|---|
| 5,498,765 | A | * | 3/1996 | Carpenter et al. | 430/323 |
| 5,502,082 | A | * | 3/1996 | Unger et al. | 521/141 |
| 5,578,217 | A | * | 11/1996 | Unger et al. | 210/670 |
| 6,036,835 | A | * | 3/2000 | Sonnenberg et al. | 205/125 |
| 6,391,188 | B1 | * | 5/2002 | Goosey | 205/746 |
| 6,472,499 | B1 | * | 10/2002 | Braat et al. | 528/215 |
| 6,624,070 | B2 | * | 9/2003 | Merricks et al. | 438/678 |
| 2002/0132042 | A1 | * | 9/2002 | Merricks et al. | 427/98 |

* cited by examiner

*Primary Examiner*—Mark L. Bell
*Assistant Examiner*—Jennine Brown
(74) *Attorney, Agent, or Firm*—S. Matthew Cairns

(57) ABSTRACT

Disclosed are new catalysts for electroless metallization deposition, particularly catalysts that can be selectively activated and may be free of palladium and/or tin. Catalysts of the invention are preferably employed for electroless copper deposition.

9 Claims, No Drawings

PLATING CATALYSTS AND ELECTRONIC PACKAGING SUBSTRATES PLATED THEREWITH

BACKGROUND OF THE INVENTION

1. Field of the Invention

The present invention relates generally to the field of plating catalysts, particularly new catalysts for electroless metallization deposition. Preferred catalysts of the invention can be selectively activated (e.g. thermally) and may be free of tin. Catalysts of the invention are preferably employed for electroless copper deposition.

2. Background

Electroless metallization can require multiple processing steps. See, for example, reviews of electroless plating in C. R. Shipley Jr., *Plating and Surface Finishing*, vol. 71, pp. 92–99; and *Metal Finishing Guidebook and Directory*, vol. 86, published by Metals and Plastics Publications, Inc. (1988). On typical sequence for metallization, such as providing a copper deposit, of polymeric substrates employs a colloidal palladium-tin catalyst in the following sequence: (1) pre-cleaning the substrate surface; (2) microetching, e.g. with a chromic-based solution; (3) conditioning the etched substrate surface; (4) adsorption of the palladium-tin catalyst onto the conditioned surface; (5) treatment with an accelerator to modify and activate the absorbed catalyst; and (6) treatment with an electroless plating solution, such as an electroless copper solution. See, for example, U.S. Pat. Nos. 4,061,588 and 3,011,920.

Electroless metal deposition has a wide range of applications, including for use in the manufacture of electronic printed circuit boards and non conductors such as decorative and engineering plastic substrates which can be used in electronic, communication, computer, plumbing parts and automotive parts among other applications of the plated products. More particularly, an electroless copper deposit plated over the walls of through-holes, vias, interconnects, etc. provides conductivity between surfaces of the substrate renders the substrate conductive and suitably prepared for electrolytically deposited topcoats or other metal or oragnic layers which confer functionality or decorative effect to the object being treated of a board and/or between circuit layers. In additive circuit manufacture, in addition to providing conductivity between surfaces and/or circuit layer, the deposit also serves as the conductor lines.

SUMMARY OF THE INVENTION

We have now found new electroless metallization catalysts compositions that can provide significantly improved capabilities and properties.

Catalysts of the invention in general comprise a copper source (e.g. copper salt) and an organic binder compound. Preferably, the catalyst's composition has an acidic component, such as provided by an organic acid, and preferably further contains a reducing agent. The catalyst composition can be formulated as a fluid, preferably as an aqueous composition.

Catalyst compositions of the invention are preferably neutral or alkaline. It is believed that maintaining a substantially neutral or Alkaline pH promoted formation of a complex of composition components, which in turn promotes enhanced properties of the composition. A pH of from about 5 to about 12 or 13 is generally suitable, more preferably a pH of about 5, 6, 7, 8, 9, 10 or 11, even more preferably a pH of about 7, 8, 9 or 10. Such a neutral or alkaline pH can be provided by addition of a suitable base to the catalyst composition. e.g. a hydroxide such as potassium hydroxide or sodium hydroxide, and the like.

Significantly, the catalyst composition can be selectively activated, e.g. thermally, via radiation, or other activation. Thus, the catalyst's composition of the invention can be applied to a substrate to provide an inactive catalyst coating layer. Upon activation of that coating layer, the coating becomes catalytic and is able to initiate metal deposition from standard electroless plating baths. Copper is a preferred metal to electrolessly plate via a catalyst of the invention.

Activation of the catalysts coating layer also can be performed to provide a catalytic image pattern. For instance, the inactive catalyst coating layer can be exposed through a photomask to activating radiation, e.g. excimer laser operating in the infrared, ultraviolet radiation e.g. having a wavelength of from 250 to 450 nm, etc. An image pattern then will be transferred to the copper catalyst layer and copper deposition will occur only in those areas activated by the transmitted radiation. The transferred image can provide e.g. a copper circuit pattern, selectively plate a via in the substrate surface, etc.

It also should be appreciated that catalysts of the invention are substantially, essentially or more preferably completely free of tin and/or palladium, in contrast to prior catalysts.

The invention also includes methods for manufacturing plating printed circuit board substrates, and other electronic packaging plated substrates, comprising use of a catalyst composition of the invention. Such methods in general comprise deposition of a catalyst composition of the invention onto an electronic packaging substrate, such as polymeric through-hole walls of a printed circuit board, and contact of the catalyst substrate surface with an electroless plating composition, particularly an electroless copper composition. The catalyst composition can be applied by a variety of methods, e.g. dip coating, spin coating, etc. The catalyst composition is preferably dried before the plating step. The deposited catalyst layer also is activated prior to the plating step, e.g. thermally or other activating radiation as discussed above.

The invention also includes articles coated with a catalyst composition of the invention, including printed circuit board substrates and other electronic packaging substrates and other non conductive substrates having a catalyst composition thereon, which may be overcoated with an electroless metal deposit, particularly an electroless copper deposit.

Other aspects of the invention are disclosed infra.

DETAILED DESCRIPTION OF THE INVENTION

As discussed above, the present invention provides compositions suitable for depositing an electroless plating catalyst on a substrate, particularly electronic packaging substrates such as a printed circuit board. Preferred catalysts compositions comprise one or more metal ions, one or more organic acids, one or more organic binders, and one or more reducing agents. The catalyst composition also preferably is substantially neutral or alkaline. Any metal salt suitable for use as an electroless plating catalyst may be used in the present invention. Such metal salts include, but are not limited to: cobalt salts, copper salts, platinum salts, palladium salts, and the like. Copper and palladium salts are the preferred catalysts. Such salts are typically at least partially soluble in the solvent used, typically water. Thus any solvent soluble metal salt is suitable. Exemplary metal salts include metal hydroxides, metal halides, metal gluconates, metal acetates, metal sulfates, metal nitrates, metal sulfonates, metal alkylsulfonates, metal arylsulfonates, metal fluoroborates and the like. The choice of such catalysts is within the ability of one skilled in the art.

The one or more metal salts are typically present in the compositions of the invention in an amount of from about 0.1 to about 15 g/L, preferably from 0.5 to 10 g/L, more preferably 1 to 8 g/L. A particularly useful range is from 2 to 5 g/L. Such metal salts are generally commercially available and may be used without further purification. Copper salts are preferred such as a Cu (II) salt e.g. cupric chloride.

As discussed above, the catalyst composition is preferably formulated with an acid component. Preferably, an organic acid is employed. A wide variety of organic acids may be advantageously used in the present invention. Suitable organic acids include, but are not limited to: ($C_1$–$C_{12}$) alkylcarboxylic acids, ($C_2$–$C_{12}$)alkyldicarboxylic acids, ($C_1$–$C_{12}$)alkyltricarboxylic acids, substituted ($C_1$–$C_{12}$) alkylcarboxylic acids, substituted ($C_2$–$C_{12}$) alkyldicarboxylic acids, substituted ($C_1$–$C_{12}$) alkyltricarboxylic acids, ($C_2$–$C_{12}$)alkenylcarboxylic acids, ($C_2$–$C_{12}$)alkenyldicarboxylic acids, ($C_2$–$C_{12}$) alkenyltricarboxylic acids, substituted ($C_2$–$C_{12}$) alkenylcarboxylic acids, substituted ($C_2$–$C_{12}$)alkenyl dicarboxylic acids, substituted ($C_2$–$C_{12}$)alkenyltricarboxylic acids and the like. By "substituted alkyl" or "substituted alkenyl" it is meant that one or more hydrogens on the alkyl or alkenyl chain is replaced with another substituent group such as halo, hydroxyl, ($C_1$–$C_6$)alkoxy, cyano, ($C_1$–$C_6$) alkylthio and the like. Particularly useful organic acids include: formic acid, acetic acid, propionic acid, oxalic acid, malonic acid, succinic acid, glutaric acid, adipic acid, glucolic acid, lactic acid, tartaric acid, citric acid, malic acid and the like.

The amount of organic acid in the catalyst compositions of the invention is typically in the range of from about 0.1 to about 25 g/L, preferably from 0.5 to 20 g/L, more preferably 2 to 15 g/L. The specific amount of organic acid will depend upon the particular metal salt and the particular organic acid chosen. The organic acids are commercially available from a variety of sources and may be used without further purification.

As discussed above, catalyst compositions also contain an organic binder. A wide variety of organic binders can be employed. Such binders are typically water-soluble or water-dispersible, and preferably water-soluble. The binders may be small molecules or polymeric. Suitable binders include cellulose, hydroxycellulose, hydroxyalkylcellulose such as hydroxymethylcellulose, hydroxyethylcellulose and hydroxypropylcellulose, polysaccharide polymers, cellulose polymers, derivatized cellulose polymers, polymers and copolymers of ethylene oxide and propylene oxide, polyurethane polymers having alternating hydrophobic and hydrophilic moieties, poly (maleic anhydride/methyl vinyl ether), polymethacrylic acid, and naphthalene formaldehyde condensates. Preferred organic binders are cellulose, hydroxycellulose, hydroxymethylcellulose, hydroxyethylcellulose and hydroxypropylcellulose.

Such binders may be used in a wide range of amounts and typically in the range of from about 1 to about 30 g/L. Preferably, the organic binders are used in an amount of form 5 to 25 g/L and more preferably 10 to 20 g/L. These binders are generally commercially and may be used without further purification.

A wide variety of reducing agents may be used in the catalyst compositions of the invention. Suitable reducing agents include, but are not limited to, hypophosphorus acid, sodium hypophosphite, potassium hypophosphite, sodium borohydride, formaldehyde, dimethylamine borane, trimethylamine borane, methylmorpholino borane, morpholino borane, diisopropylamine borane, L-sodium ascorbate, sodium phosphite, potassium phosphite, tartaric acid, glucose, glycerine, sodium N,N-diethylglycine, sodium formate, potassium formate, titanium trichloride, hydrazine, thiourea, methylthiourea, N-methylthiourea, N-ethylthiourea, hydroquinone, bivalent cobalt compounds, and the like. Preferred reducing agents include hypophosphorus acid, sodium hypophosphite and sodium formate.

The reducing agents are typically present in the compositions of the invention in an amount of from about 5 to about 60 g/L, preferably 10 to 50 g/L. Such reducing agents are generally commercially available and may be used without further purification.

Catalyst compositions of the invention also may contain a base to provide a substantially neutral or alkaline catalyst composition. The base may be integral to a catalyst component such as the organic binder, or more typically the base is present as a separate, additional composition component. Any suitable organic or inorganic base may be used in the present compositions. Suitable bases include, but are not limited to: lithium hydroxide, sodium hydroxide, potassium hydroxide, ammonium hydroxide, tetra($C_1$–$C_4$) alkylammonium hydroxide such as tetramethylammonium hydroxide, and the like. Such bases are present in the compositions in an amount sufficient to provide a pH of the compositions of about 5, 6 or 7 or greater, preferably from about 7.5 to about 13.5, more preferably from 8 to 13, still more preferably from 8.5 to 12, and even more preferably from 10 to 12. The particular pH employed depends in part upon the choice of metal salt. For example, when a copper salt is used in the present compositions, a particularly suitable pH range is from about 7.5 to about 8.0. The base may be added to the formed catalyst composition, or admixed with other catalyst components during make-up of the composition.

The present compositions may be prepared by combining the one or more metal salts, one or more organic acids, one or more organic binders, and one or more reducing agents and, if employed, one or more separate basic components in any order. Typically, the present compositions are prepared in water, but may be prepared in one or more organic solvents or in a mixture of water with one or more organic solvents. Such organic solvents may include, but are not limited to, polyhydroxy compounds such as alkanediols and alkanetriols, glycol ethers, glycol ether acetates, and the like. Alkanediols include ($C_1$–$C_{24}$)alkanediols such as glycols such as ethylene glycol, propylene glycol and the like. Exemplary glycol ethers include: ethylene glycol monomethyl ether, ethylene glycol monobutyl ether, diethylene glycol monomethyl ether, diethylene glycol monobutyl ether, triethylene glycol monomethyl ether, triethylene glycol monobutyl ether, diethylene glycol dimethyl ether, diethylene glycol dibutyl ether, propylene glycol monomethyl ether, propylene glycol monobutyl ether, dipropylene glycol monomethyl ether, dipropylene glycol monobutyl ether, tripropylene glycol monomethyl ether, tripropylene glycol monobutyl ether, propylene glycol dimethyl ether, propylene glycol dibutyl ether, dipropylene glycol dimethyl ether, dipropylene glycol dibutyl ether and the like. Other suitable solvents include propylene glycol monomethyl ether acetate. Water and mixtures of water and organic solvents are preferred, and water is more preferred.

The catalyst compositions of the invention may be applied to a substrate by a wide variety of means such as dipping, spraying, flood coating, screen printing, roller coating, spin-coating and the like. As discussed above, preferred substrates include electronic packaging devices, particularly printed circuit boards. A preferred substrate is a printed circuit board, wherein the catalyst composition is coated onto through-hole walls, or across a circuit layer surface.

The amount of such electroless plating catalyst deposited on the substrate is determined by the thickness of the applied composition coating or film. Thus, the amount of catalyst deposited may be controlled by controlling the amount of the composition applied to the substrate. Such compositions applied to the substrate form substantially continuous films, i.e. the film of the complex covers >95% of the surface area of the substrate, preferably >98%, and more preferably >99%.

Once the present compositions are applied to or coated onto a substrate, they are typically dried to provide a uniform inactive catalytic film. Such drying may be by a variety of means. Preferably, such drying is performed by heating. Typically such heating is performed at a temperature lower than that need to activate the catalyst. For example, the coated substrate may be dried in air at a temperature of up to about 100° C., and preferably up to about 90° C. Typical drying times will vary with the solvent used in the catalyst composition and the thickness of the catalyst layer applied. Such times will be within the ability of one skilled in the art, but duration may be up to 60 minutes, preferably up to 45 minutes, and more preferably up to 30 minutes.

After drying, the inactive catalytic film is activated prior to electroless metal deposition. Thus, the present method further includes an activation step. The inactive catalytic film may be activated by a variety of means such as heating such as at elevated temperatures, exposure to carbon dioxide or excimer lasers, exposure to ultraviolet radiation and the like. Preferably, catalyst is activated by heating at elevated temperatures such as by placing the catalyst coated substrate in an oven. Such heating is typically at a temperature of about ≧100° C., preferably ≧110° C., more preferably ≧120° C., still more preferably ≧130° C., and even more preferably ≧140° C. or greater such as ≧200° C. Such heating to activate the catalyst is typically up to 180 minutes, preferably up to 120 minutes, more preferably up to 60 minutes, and even more preferably up to 15 minutes. Those skilled in the art will appreciate that selective activation of the catalyst is possible using a laser or using UV radiation through a mask. Further, the substrate deformation temperature will control and limit the maximum temperature for activation.

Once the present catalysts are activated, they may be electrolessly plated by a wide variety of metals. Suitable metals that can be electrolessly deposited include, but are not limited to, copper, nickel, gold, silver, cobalt, palladium, platinum, iron and the like. Such electroless plating solutions typically contain one or more metal ions, one or more reducing agents and optionally a complexing agent. Typically, electroless plating solutions are aqueous, but may also contain one or more organic solvents. A generally preferred plating composition is a copper electroless composition.

The invention also includes methods for manufacturing a coated part including the steps of contacting a substrate with a composition including one or more metal salts particularly a copper salt; an acid particularly one or more organic acids; one or more organic binders; and optionally one or more reducing agents and base; activating the catalyst; and contacting the catalyst with an electroless plating solution. Accordingly, the present invention further provides an electronic packaging device, particularly a printed circuit board, c including an electroless plating catalyst wherein the catalyst is deposited from a composition including one or more metal salts particularly a copper salt, an acid particularly one or more organic acids, one or more organic binders, and one or more reducing agents.

Once the present catalysts are activated, they may be electrolessly plated by a wide variety of metals. Suitable metals that can be electrolessly deposited include, but are not limited to, copper, nickel, gold, silver, cobalt, palladium, platinum, iron and the like. Preferably the electroless plating bath is an electroless copper plating bath. Such electroless plating solutions typically contain one or more metal ions, one or more reducing agents and optionally a complexing agent. Typically, electroless plating solutions are aqueous, but may also contain one or more organic solvents.

The metals ions may be present in the electroless plating baths in any soluble form, such as nitrates, sulfates, sulfonates, alkylsulfonates, arylsulfonates, halides, fluoroborates, gluconates, acetates and the like. The amount of such metal ions depends upon the metal to be deposited and the particular electroless bath used. Such amounts are within the ability of one skilled in the art.

A wide variety of reducing agents may be used in such electroless baths. Suitable reducing agents include, but are not limited to, sodium hypophosphite, potassium hypophosphite, sodium borohydride, formaldehyde, dimethylamine borane, trimethylamine borane, methylmorpholino borane, morpholino borane, diisopropylamine borane, L-sodium ascorbate, sodium phosphite, potassium phosphite, tartaric acid, glucose, glycerine, sodium N, N-diethylglycine, sodium formate, potassium formate, titanium trichloride, hydrazine, thiourea, methylthiourea, N-methylthiourea, N-ethylthiourea, hydroquinone, bivalent cobalt compounds, and the like. For electroless copper baths, formaldehyde, dimethylamine borane and sodium borohydride are preferred. The amount of such reducing agent in the electroless bath is well known to those skilled in the art.

Optionally, the electroless baths may contain one or more complexing agents, such as ethylenediamine, EDTA, tetramethylenediamine, citrate salts, tartrate salts, Rochelle salts, Quadrol and the like.

The substrate containing the activated catalyst is typically contacted with an electroless plating bath at a temperature and for a time sufficient to deposit the desired metal layer. Such times and temperatures vary according to the metal to be deposited and the particular electroless plating bath used. Typically, such electroless plating may be performed at a temperature from below room temperature to about 95° C., and preferably from 25° to 80° C. Suitable plating times are typically at least about 0.25 minutes, preferably at least about 0.5 minute, and more preferably at least about 5 minutes. Other suitable plating times include at least about 20 minutes. There is no real upper limit to the plating time used. Thickness of the deposit is proportional to the time in the electroless plating solution.

It will be appreciated that the substrates may be plated until any apertures or surface features present in the substrates are substantially filled or completely filled by the electroless metal deposit. This has the advantage that only one plating bath needs to be employed in the plating of such substrates. As electroless deposition tends to be conformal, it is preferred that the electroless metal deposit does not completely fill the apertures. Thus, it is preferred that the electroless deposit partially fills the apertures and then the substrate is removed from the electroless bath and plated electrolytically, preferably with the same metal. In this way, void-free bottom-up fill is provided in small apertures, and particularly in apertures $\leqq 0.18\ \mu m$.

Accordingly, the present invention also provides an article of manufacture including an electronic packaging device substrate, particularly a printed circuit board, containing one or more apertures, each aperture containing an electroless metal deposit obtained from the method of the present invention.

All documents mentioned herein are incorporated herein by reference in their entirety. The following examples are presented to illustrate further various aspects of the present invention, but are not intended to limit the scope of the invention in any aspect.

EXAMPLE 1

A composition of the invention can be prepared by admixing the following components:

| | |
|---|---|
| Cupric chloride | 3.15 g/l |
| Tartaric acid | 2.12 g/l |
| Hydroxypropyl cellulose | 11.0 g/l |
| Potassium hydroxide solution (13.4 M/l) | 4.45 ml/l |
| Hypophosphorus acid | 10–25 g/l |
| or Sodium hypophophite | 10–40 g/l |
| or Sodium formate | 10–50 g/l |

The pH is adjusted to between 8.5 and 9.0 using potassium hydroxide or tartaric acid. The composition is coated onto substrates by dip coating or spin coating. After coating, the substrates are dried in air at 90° C. for 30 minutes.

The coated substrates can be activated by heating to 130° C. or above for periods between one and two hours. Activation time will generally decrease with increased temperature. Following activation, the coated substrate can be immersed in an electroless copper bath to initiate deposition. A preferred copper bath is Electroless Copper Bath 4750 sold by the Shipley Company of Marlborough, Mass.

The foregoing description of the invention is merely illustrative thereof, and it is understood that variations and modifications thereof can be made departing from the spirit or scope of the invention as set forth in the following claims.

What is claimed is:

1. A composition suitable for depositing an electroless plating catalyst on a printed circuit board substrate through hole wall surface comprising one or more metal salts, one or more organic acids, one or more organic binders, and one or more reducing agents.

2. The composition of claim 1 wherein the one or more metal salts are selected from copper and palladium salts.

3. The composition of claim 1 wherein the one or more metal salts are copper salts.

4. The composition of claim 1 wherein the one or more metal salts comprise one or more Cu(II) salts.

5. The composition of any one of claim 1 wherein the one or more organic acids are selected from $(C_1–C_{12})$ alkylcarboxylic acids, $(C_2–C_{12})$alkyldicarboxylic acids, $(C_1–C_{12})$alkyltricarboxylic acids, substituted $(C_1–C_{12})$ alkylcarboxylic acids, substituted $(C_2–C_{12})$ alkyldicarboxylic acids, substituted $(C_1–C_{12})$ alkyltricarboxylic acids, $(C_2–C_{12})$alkenylcarboxylic acids, $(C_2–C_{12})$alkenyldicarboxylic acids, $(C_2–C_{12})$ alkenyltricarboxylic acids, substituted $(C_2–C_{12})$ alkenylcarboxylic acids, substituted $(C_2–C_{12})$ alkenyldicarboxylic acids and substituted $(C_2–C_{12})$ alkenyltricarboxylic acids.

6. The composition of any one of claim 1 wherein the one or more organic acids are selected from formic acid, acetic acid, propionic acid, oxalic acid, malonic acid, succinic acid, glutaric acid, adipic acid, glucolic acid, lactic acid, tartaric acid, citric acid of and malic acid.

7. The composition of claim 1 wherein the one or more organic binders are selected from cellulose, hydroxycellulose, hydroxyalkylcellulose such as hydroxymethylcellulose, hydroxyethylcellulose and hydroxypropylcellulose, polysaccharide polymers, cellulose polymers, derivatized cellulose polymers, polymers and copolymers of ethylene oxide and propylene oxide, polyurethane polymers having alternating hydrophobic and hydrophilic moieties, poly(maleic anhydride/methyl vinyl ether), polymethacrylic acid and naphthalene formaldehyde condensates.

8. The composition of claim 1 wherein the composition is substantially neutral or alkaline.

9. The composition of claim 1 wherein the composition further comprises a basic component.

* * * * *